US005938109A

United States Patent [19]

Sainz et al.

[11] Patent Number: 5,938,109

[45] Date of Patent: Aug. 17, 1999

[54] CARTON AND ONE-PIECE PRODUCTION BLANK THEREFOR

[76] Inventors: Raymond Sainz, 3224 Bryant St., Denver, Colo. 80211; Michael Wise, P.O. Box 849, Arvada, Colo. 80001; Carl Dewitt, 9340 Raleigh Crt., Westminster, Colo. 80030; Kory Kime, 11651 W. 76th. Dr., Arvada, Colo. 80005

[21] Appl. No.: 08/806,454

[22] Filed: Feb. 26, 1997

[51] Int. Cl.[6] ..... B65D 5/4805

[52] U.S. Cl. ..... 229/120.21; 229/120.11; 229/120.18

[58] Field of Search ..... 229/120.03, 120.04, 229/120.13, 120.18, 120.21, 120.32, 120.11; 206/723, 725

[56] References Cited

U.S. PATENT DOCUMENTS

| | | | |
|---|---|---|---|
| 2,305,087 | 12/1942 | Keller | 229/120.13 |
| 2,643,811 | 6/1953 | Bolding | 229/120.18 |
| 2,850,224 | 9/1958 | Meinhardt et al. | 229/120.21 |
| 3,185,379 | 5/1965 | Kohlhaas | 229/120.11 |
| 4,143,803 | 3/1979 | Taylor | 229/120.11 |
| 4,836,383 | 6/1989 | Gordon et al. | 229/120.21 |
| 5,076,492 | 12/1991 | Tupes | 229/120.21 |
| 5,242,107 | 9/1993 | De Nola | 229/120.21 |
| 5,366,141 | 11/1994 | Stone | 229/120.11 |
| 5,413,276 | 5/1995 | Sheffer | 229/120.11 |

OTHER PUBLICATIONS

The Wiley Encyclopedia of Packaging Technology, John Wiley &Sons, pp. 68–68, 1986.

*Primary Examiner*—Gary E. Elkins
*Attorney, Agent, or Firm*—Timothy J. Martin; Michael R. Henson

[57] ABSTRACT

A carton is disclosed adapted to package a plurality of items for shipment, especially laptop computers and accessories. The carton includes a sidewall, end closures formed by plurality of flaps, and a shelf assembly forming compartments in the carton. The shelf assembly includes a shelf panel, support pieces secured to the sidewall, and a spacer panel. A lip piece hinged to the spacer panel engages the sidewall to permit selective positioning of the spacer panel in different closed positions to accommodate differently sized contents.

20 Claims, 4 Drawing Sheets

CARTON AND ONE-PIECE PRODUCTION BLANK THEREFOR

FIELD OF THE INVENTION

The present invention broadly relates to cartons used in the packaging of selected items for shipment. Of special concern is the packaging of lap top computers and accessories therefor in an easy and convenient manner. The invention is also directed to a one-piece production blank that may be folded into such a carton.

BACKGROUND OF THE INVENTION

Modern commerce requires the shipment of a wide variety of goods from raw material sources to manufacturing sites and thereafter to various points of distribution. As goods reach a more finished state, manufacturers usually take increasing care to package such products so as to reduce the risk of damage during storage and shipment. Accordingly, a wide variety of packaging systems have been developed.

Many of such packaging systems employ a box-like carton, usually formed of a corrugated material such as a paperboard. Such cartons are highly desirable due to their relatively low cost and ease of manufacture. Items placed in such boxes or cartons may be cushioned against damaging impacts by a variety of shock absorbing materials, such as foam, bubble pack, styrofoam pellets, etc., as are known in the prior art.

In recent times, a need has arisen for packaging systems that are particularly suitable for protecting electronic equipment during shipment and storage. Due to the delicacy of such equipment, increasingly better ways are needed to package and ship such items. The rapid growth of the computer industry has placed substantial demands for packaging innovation.

At the same time, though, competitiveness among manufacturers of computer equipment necessitates cost savings at virtually every level of production, including packaging. Even though computer equipment constitutes a relatively high purchase decision from many households, manufacturers are under extra ordinary pressures to implement savings in the distribution of these products to the consumer.

As a result, manufacturers need packaging systems that are a less expensive without significantly increasing risk of damage to the delicate equipment. Moreover, such manufacturers need packaging systems that can introduce cost savings during the packaging process because workers can more efficiently use such systems and thus reduce the time and money needed in the packaging operation. The present invention is directed to these needs.

SUMMARY OF THE INVENTION

It is an object of the present invention to provide a new and useful packaging system for use in packaging a variety of items, especially for shipment.

Another object of the present invention is to provide a carton that is relatively inexpensive in cost yet which can simply and efficiently package different selected items for shipment.

A further object of the present invention is to provide a carton out of a one-piece construction of corrugated material that simplifies the packaging of items, such as electronic components.

Still a further object of the present is to provide a carton having a pair of compartments that is particularly useful in the packaging of a lap top computer and its accessories.

Yet a further object of the present invention is to provide a carton of one-piece corrugated construction that has multiple compartments with at least one of which having a built-in adjustable spacer.

According to the present invention then, a carton is adapted for packaging a plurality of items for shipment, especially lap top computers and their accessories. The carton is formed of a one-piece production blank of corrugated material, preferably a paper material. In its broad form, the carton has a sidewall which extends around an interior that is adapted to receive the selected items. First and second end closures are operative to respectively close the first and second open ends of the interior. A shelf panel is disposed in the interior and is supported relative to the sidewall in spaced relation to a portion of the sidewall thereby to separate the interior region into first and second compartments respectively adapted to receive different ones of the selected items.

The shelf panel is provided as part of as a shelf panel assembly with portions of the shelf panel affixed to the sidewall at spaced locations. The shelf panel is preferably parallel to the sidewall and which has a longitudinal length measured between the open ends; the shelf panel thus extends at least a majority of the longitudinal length of the sidewall. The shelf panel has a first shelf edge facing the first open end, and a spacer panel is hingedly secured along the first shelf edge with the spacer panel operative to selectively enclosure the first interior region of the first compartment or alternatively, to open for access to the first interior region. This spacer panel has selectable closed positions that alter the volume of the first compartment. Here, a lip is provided on the spacer panel to retain it in a selected one of the closed position. Also, tab pieces may be provided on the spacer panel on opposite side edges with these tab pieces frictionally engaging the inner surface of the sidewall to help support the shelf panel and help retain the spacer panel in the selected closed position.

The sidewalls are preferably rectangular in cross-section and formed by a top panel, a bottom panel and a pair of side panels. Here, the end closures are formed by flaps that are respectively opposite longitudinal extensions of the sidewall panels. The shelf is parallel to both the top and bottom walls and is secured to each of the side panels so that it may erect automatically when the carton is unfolded from a collapsed position to an open position. An aperture is formed in the spacer panel to help manual access to enable movement of the spacer panel from the closed position to the open position by a user when unpacking the shipped items.

These and other objects of the present invention will become more readily appreciated and understood from a consideration of the following detailed description of the exemplary embodiment when taken together with the accompanying drawings, in which:

BRIEF DESCRIPTION OF THE DRAWINGS

FIG. 6(*b*) is a cross-sectional view, similar to FIG. 6(*a*), but showing the spacer panel in a second closed position thereby showing the adjustability of the spacer panel;

DETAILED DESCRIPTION OF THE EXEMPLARY EMBODIMENTS

Figure 1:
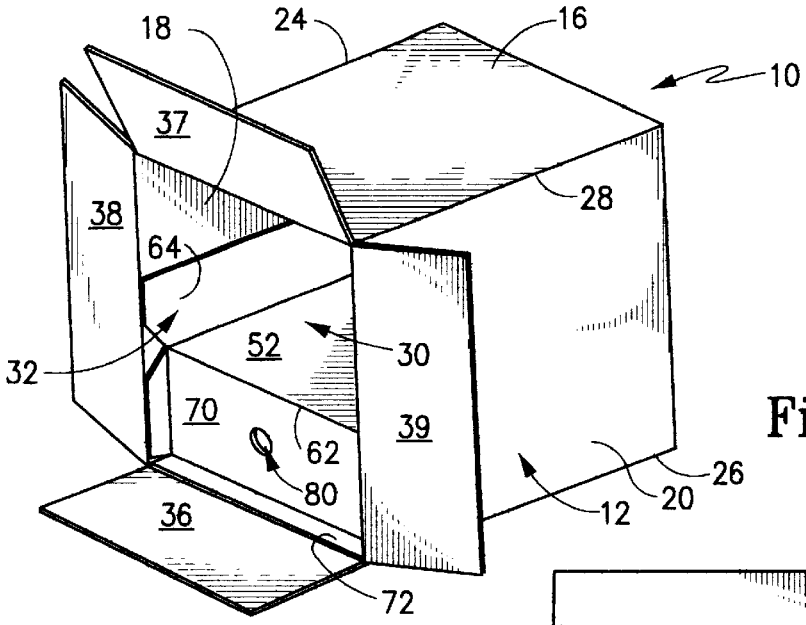
FIG. 1 is a perspective view of a first exemplary embodiment of a carton according to the present invention.

The present invention is directed to cartons which may be used to package different selected items, especially for shipment. Specially, the present invention is adapted to package electronic equipment, such as lap top computers, as well as accessories for such equipment. Therefore, while the present invention is described with respect to the packaging of lap top computers for shipment, it should be understood that packaging of other items is within the purview of the claims.

With this understanding in mind, a first exemplary embodiment of the present invention is shown in FIGS. 1–7. In these figures, it may be seen that carton 10 is formed by a sidewall 12 that, in the exemplary embodiment, is constructed of four panels. Here, it may be seen that a bottom panel 14 is in opposed parallel relationship to a top panel 16. A pair of oppositely disposed side panels 18 and 20 are spaced apart from one another and are parallel so as to extend between opposite longitudinally extending lateral side edges of bottom panels 14 and 16. Thus, it may be seen that side panel 18 extends between longitudinally extending bottom edge 22 and a longitudinally extending top edge 24. Similarly, side panel 20 extends between a longitudinal bottom edge 26 and a longitudinal top edge 28. Accordingly, sidewall 12 extends around an interior 30 that is adapted to receive selected items for storage and/or shipment. Interior 30 has opposite first and second open ends 32 and 34.

Figure 2:
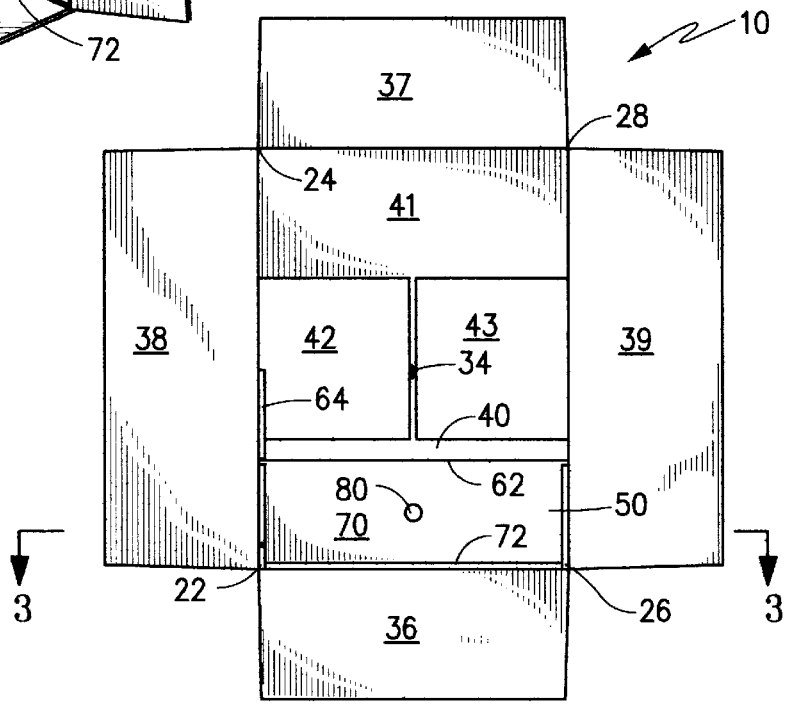
FIG. 2 is an end view in elevation showing the carton of FIG. 1.
Figure 3:
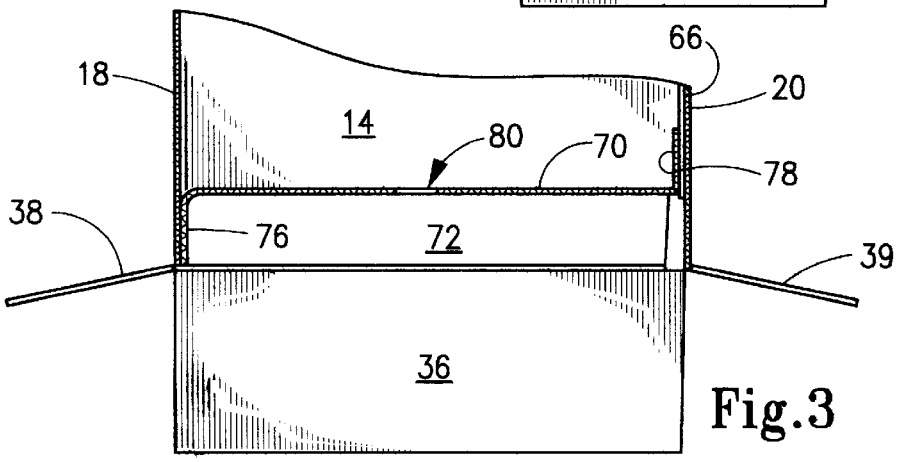
FIG. 3 is a cross-sectional view taken about lines 3—3 of FIG. 2.
Figure 5:
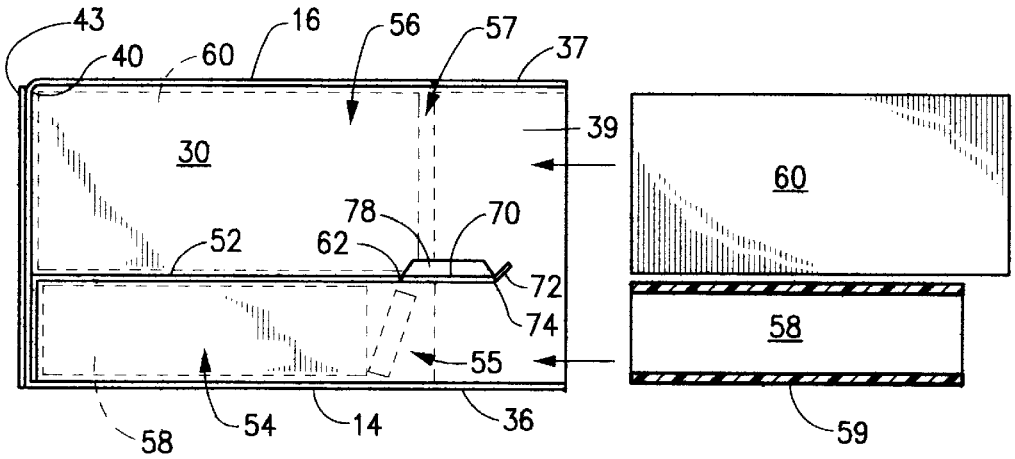
FIG. 5 is a side view in partial cross-section showing the packing of the carton of FIGS. 1–4.
Figure 4:
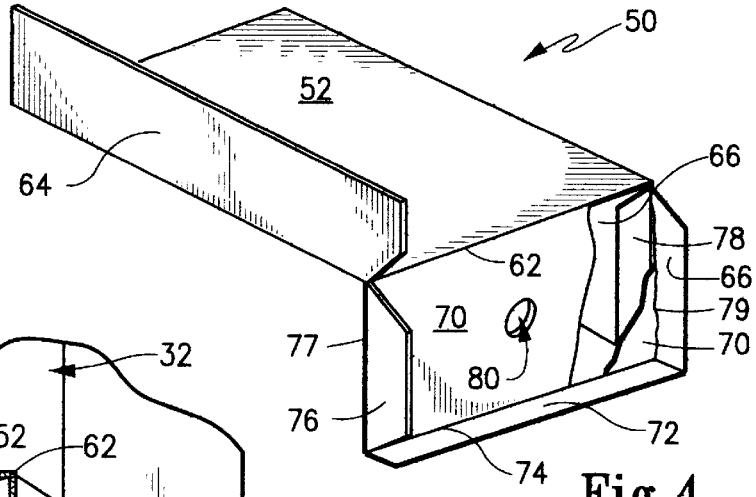
FIG. 4 is a perspective view of the shelf panel assembly used with the carton of FIGS. 1–3.

As is best show in FIGS. 1, 2 and 5, first and second end closures are provided, respectively, for first open end 32 and second open end 34. In these figures, the first end closure is constructed by a plurality of closure flaps 36, 37, 38 and 39 while second end closure is formed by second closure flaps 40, 41, 42 and 43. Preferably, end closure flaps 36 and 40 are longitudinal extensions of bottom panel 14 while end closure flaps 37 and 41 are longitudinal extensions of top panel 16. Similarly, end closure flaps 38 and 42 are longitudinal extensions of side panel 18 while end closure flaps 37 and 43 are longitudinal extensions of side panel 20. End closure flaps 36–43 are foldable about score lines discussed more thoroughly below.

In any event, the first exemplary embodiment of the present invention utilizes a shelf assembly 50 which is includes by a shelf panel 52 that is disposed in the interior 30 and is supported relative to sidewall 12 in spaced relation to a portion of sidewall 12 thereby to separate the interior region into first and second compartments. Thus, for example, it may be seen in FIGS. 1–6, shelf panel 52 is oriented in parallel relation to a portion of sidewall 12, namely, bottom panel 14. In FIG. 5, it may be seen that shelf panel 52 separates interior region 30 into a first compartment 54 and a second compartment 56 respectively sized and adapted to receive different ones of the selected items such as a lap top computer 58 (wrapped in a foam padding 59) and an accessory pack 60 for the lap top computer. Thus, first compartment 54 has a first interior region 55 while second compartment 56 has sa second interior region 57 with interior regions 55 and 57 thus defining the volume of interior 30.

The construction of shelf assembly 50 is best shown in FIGS. 3–6. Here it may be seen that shelf panel 52 has a first shelf edge 62 that extends transversely relative to the longitudinal extension of sidewall 12 in interior 30 so as to face first open end 32. Shelf panel 52 is preferably affixed to sidewall 12 at spaced locations. To this end, shelf panel 52 includes first and second shelf support pieces 64 and 66 which are respectively secured to first and second side panels 18 and 20. This may be accomplished by gluing or other known attachment techniques. As is shown in these figures, each of shelf support pieces 64 and 66 are formed as lateral extensions of shelf panel 52. Shelf panel 64 projects upwardly into second compartment 56 while second shelf support piece 66 extends into first compartment 54. Moreover, it should be understood that the assembly of surrounding sidewall 12 is completed by the joinder of side panel 20 to second shelf support piece 66 by adhesive glue or otherwise.

To this end also, it should be understood that each of first and second shelf support pieces 64 and 66 are attached to an inner surface of sidewall 12, that being the inner surfaces of each of bottom panel 14, top panel 16, side panel 18 and side panel 20 which faces the interior 30. Moreover, since shelf panel 52 is preferably in parallel spaced relation to bottom panel 14, it is also in parallel spaced relation to top panel 16 when sidewall 12 is formed to have a rectangular cross-section.

Spacer assembly 50 also includes a spacer panel 70 which is formed as a longitudinal extension of shelf panel 52. Spacer panel 70 is pivotally or hingedly secured to shelf panel 52 along transversely extending first shelf edge 62. Spacer panel 70 is sized and operative to enclosure first compartment 54. Accordingly as may be seen in FIG. 5, spacer panel 70 may move between an open position to a closed position (shown in phantom) wherein the first interior region of first compartment 54 is substantially enclosed.

Figure 6A:
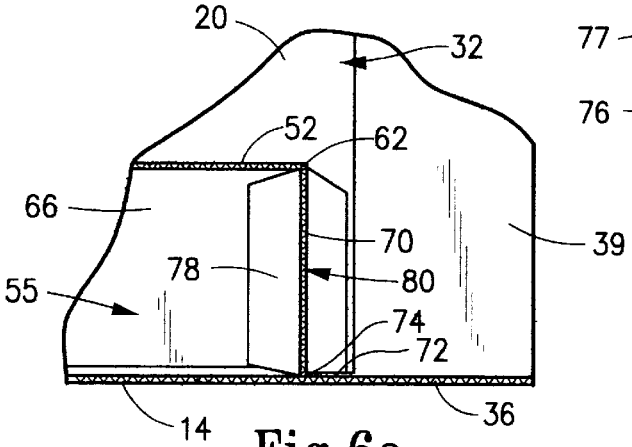
FIG. 6(*a*) is a side view in cross-section showing the closure flap used with the first exemplary embodiment of the present invention, with the spacer panel being in a first closed position.
Figure 6B:
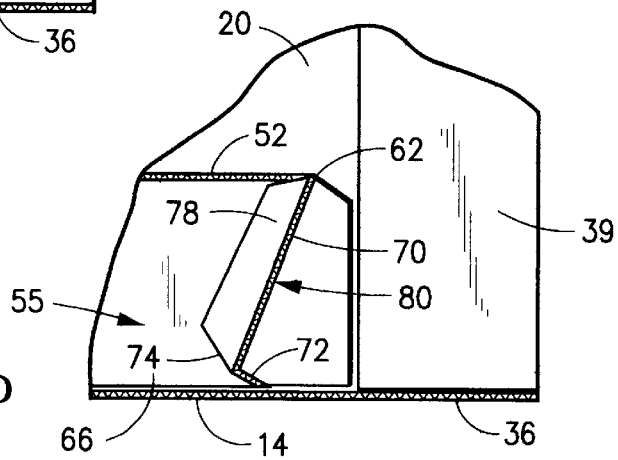

In order to retain spacer panel 70 in the closed position, a lip piece 72 is formed as a longitudinal extension of spacer panel 70 with lip piece 72 adapted to frictionally engage the inner surface of bottom wall 14 (see FIGS. 6(*a*) and 6(*b*)). Lip piece 72 extends along a spaced panel edge 74 of spacer panel 70 to which lip 72 is pivotally or hingedly connected. As is shown in FIGS. 6(*a*) and 6(*b*), lip piece 72 permits selective positioning of spacer panel 70 in different closed position that establish different volumes for the first interior region 55. This allows spacer panel 70 to help position and retain equipment such as computer 58, in compartment 54, and accommodates differently sized equipment.

To further enhance the frictional positioning of spacer panel 70 at the different closed positions, spacer panel 70 is also provided with a pair of opposite tab pieces 76 and 78 which are formed as lateral extensions of spacer panel 70. Tab piece 76 is connected to spacer panel side edge 77, formed by a score line, and tab piece 78 is connected to spacer panel side edge 79, also by a score ine. When shelf assembly 50 is in an erected condition, tab piece 76 projects outwardly of first interior region 55 while tab piece 78 is preferably oriented to extend inwardly into first interior region 55. Thus, not only do tab pieces 76 and 78 help the frictional positioning of spacer panel 70 to change the volume of first compartment 54, but they also provide further support and rigidity to shelf panel 52.

As may be seen again in reference to FIGS. 1–6, sidewall 12 has a longitudinal length measured between open ends 32 and 34 with shelf panel 52 preferably extending a majority of this longitudinal length. That is, as is seen in reference to FIG. 1, shelf panel 52 is inset slightly from first open end 32 which is defined by the hinged connection of panels 37–39 to sidewall 12. Shelf panel 52 further preferably extends the complete transverse width between side panels 18 and 20. To facilitate opening of spacer panel when it is in the closed position, an aperture 80 is provided centrally of spacer panel 70. Aperture 80 is sized and adapted to permit manual engagement of spacer panel, such as, for example, by the finger of a user.

Figure 7:
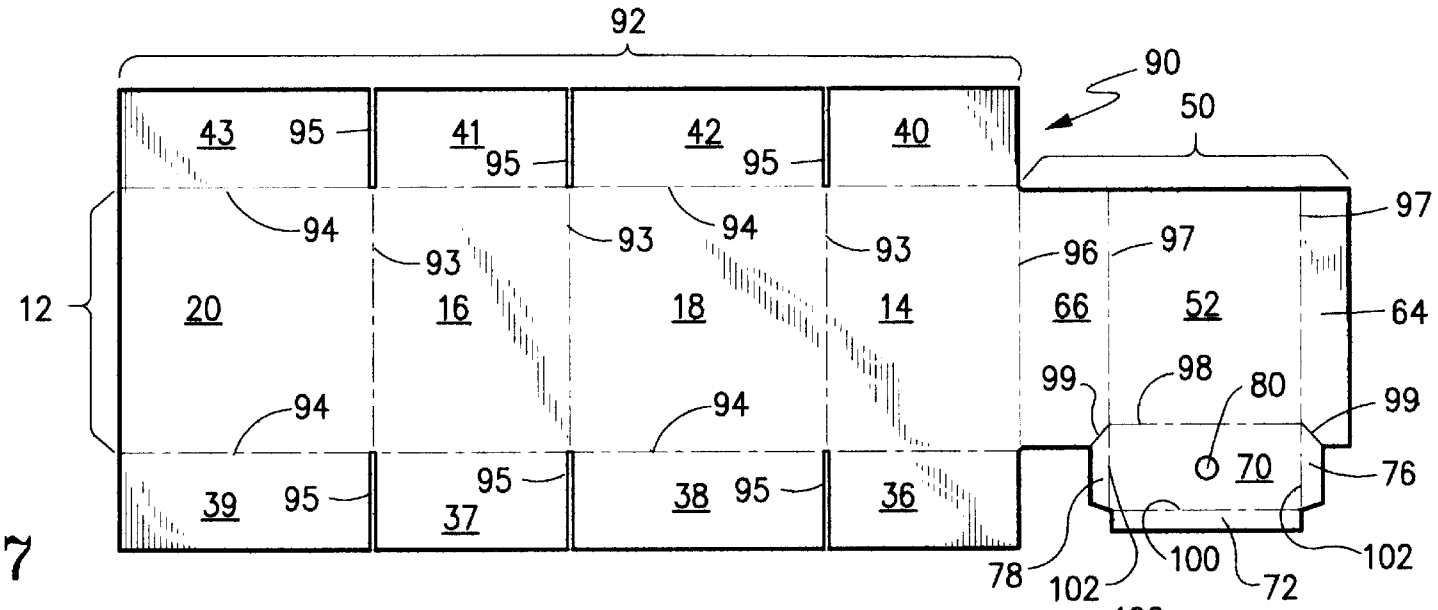
FIG. 7 is a top plan view showing a one-piece production blank used to construct the carton of the first exemplary embodiment of the present invention.

As is shown in FIG. 7, the construction of carton 10 may be accomplished by means of a single, integral one-piece construction blank 90 which is preferably corrugated fiber board formed of a corrugated material, such as paper board, adapted to be folded and fastened into carton 10. Sidewall 12 along with flaps 36–43 are formed of a main body portion 92 having longitudinal extending, parallel score or fold lines 93 which separate the sidewall panel pieces and a transverse score or fold lines 94 which separate the closure flaps 36–43 from the sidewall 12. Longitudinal cuts 95 are formed as extensions of fold lines 93 in order to separate flaps 36–43 from each other.

Shelf assembly 50 is formed integrally with main body panel portion 92 at a longitudinally extending score line 96, and parallel longitudinal score or fold lines 97 are provided to define shelf panel 52 and first and second shelf support pieces 64 and 66. Transverse fold line 98 along with cuts 99 separate spacer panel 70 from shelf panel 52. Lip piece 72 is formed by a transverse score line 100 that is parallel to score line 98. Finally, tab pieces 76 and 78 are formed by score lines 102 that are parallel to one another and are slightly inset but parallel to score lines 97.

In construction, then, glue is applied to the exposed side of shelf support piece 64, as exposed in FIG. 7. Shelf assembly is then folded along score line 96 so that first shelf support piece 64 is adhered to a mid-portion of side panel 18. Glue is now applied to the outer surface of second shelf support piece 66 and, panel pieces 16 and 18 are folded relative to one another so that side panel 20 is glued to the backside of second shelf support piece 66.

When it is desired to use carton 10, then, it is simply expanded from a collapsed position to the expanded position shown in FIG. 1 with flaps 40–43 being glued to close second open end 34, as is shown in FIG. 5. The selected items to be packaged for storage and/or shipment are now inserted into the first and second compartments 54 and 56, and spacer panel 70 is pivoted into position to adjust the size of first interior region 55 to correspond to the size of the item placed therein, such as lap top computer 58. Flaps 36–39 are then glued into position to complete the formation of the carton 10 with the items for shipment received therein.

Due to the fact that shelf support pieces 64 and 68 are glued relative to sidewalls 18 and 20, and due to the rectangular construction of carton 10, it should now be understood that shelf assembly 50 will automatically move between a stored state wherein shelf panel 52 is in parallel confronting relation to panels 14 and 18 to an erect state when sidewall 12 is in an open condition shown in FIG. 1. That is, movement of the sidewall from a collapsed condition to the open condition automatically moves shelf panel 52 into the erected state wherein it is in parallel spaced relation to bottom panel 14.

Figure 11:
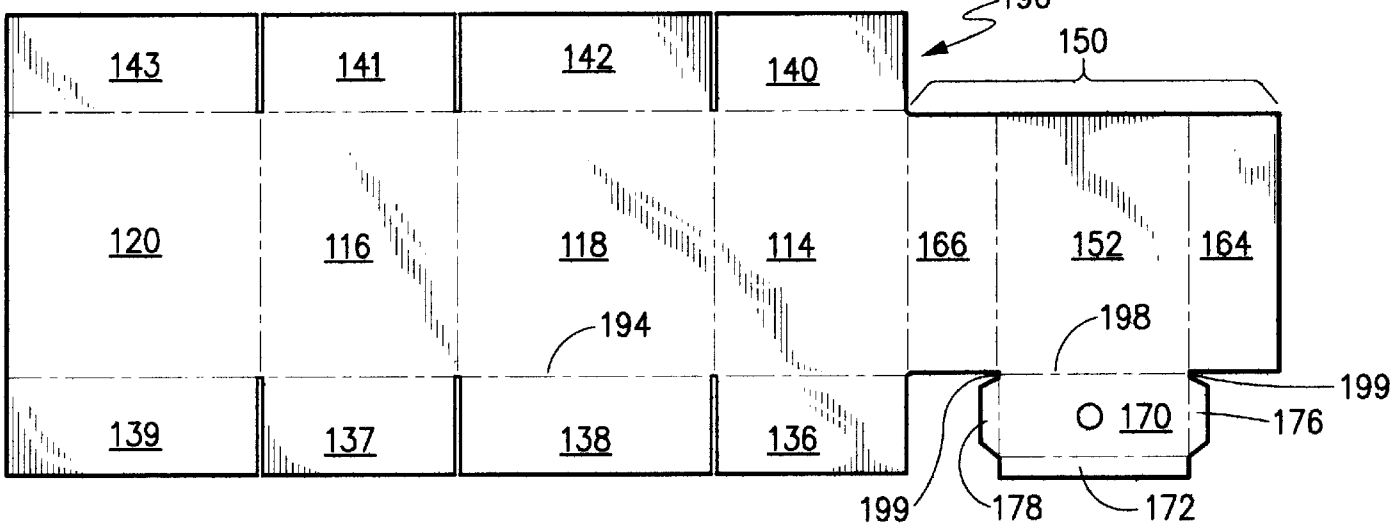
FIG. 11 is a top plan view showing a one-piece production blank used to construct the carton according to the second exemplary embodiment of the present invention.
Figure 8:
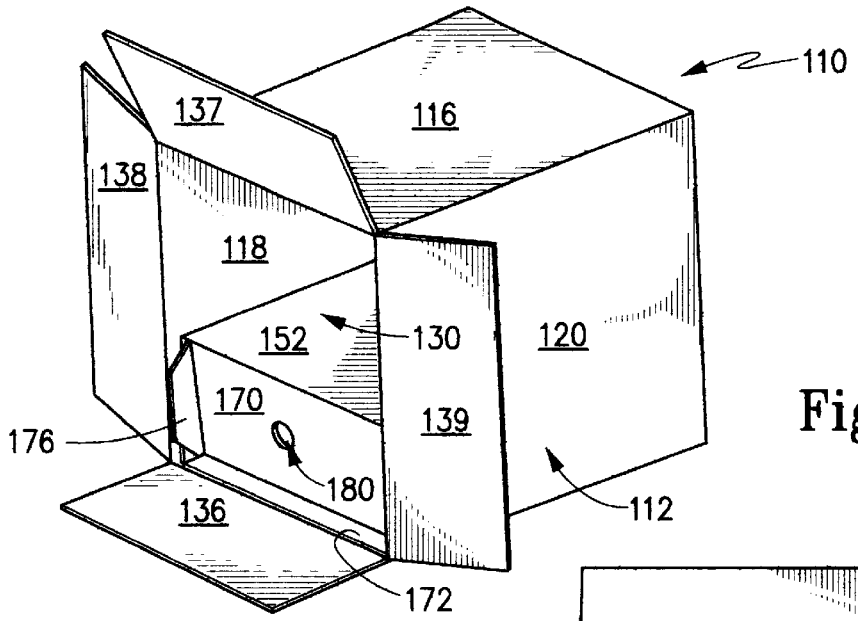
FIG. 8 is a perspective view showing a carton according to a second exemplary embodiment of the present invention.
Figure 9:
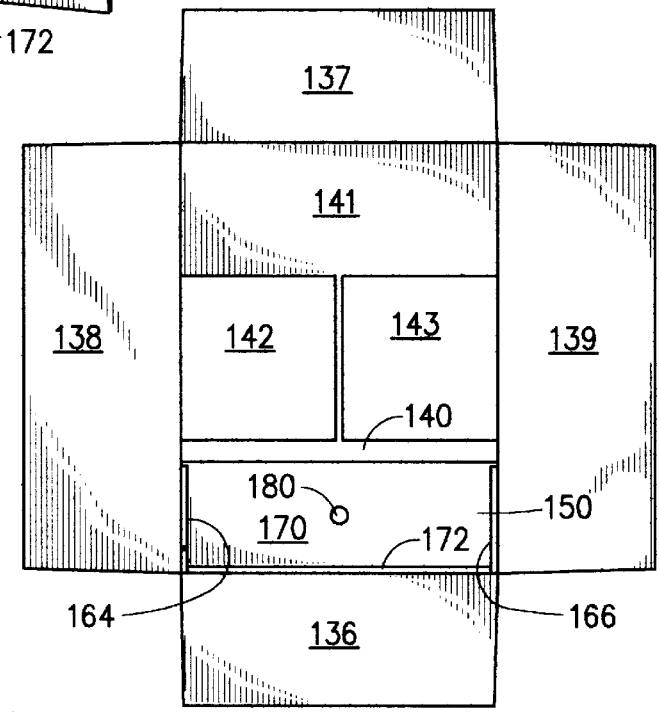
FIG. 9 is an end view in elevation showing the carton of FIG. 8.
Figure 10:
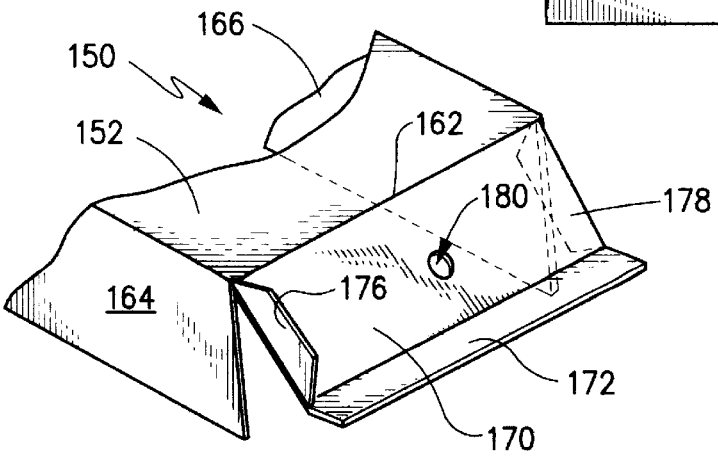
FIG. 10 is a perspective view of the shelf assembly used with the second exemplary embodiment of the present invention shown in FIGS. 8–9.

A second exemplary embodiment of the present invention is shown in FIG. 8–10 and the one-piece production blank therefor shown in FIG. 11. Here, it should be appreciated that the primary difference is in the construction of shelf panel assembly 150. With reference to FIG. 8–10, it may be seen that carton 110 includes a sidewall 112 formed by bottom panel 114, top panel 116, side panel 118 and side panel 120. First closure flaps 136–139, and second closure flaps 140–143 respectively enclose first and second open ends of an interior region 130.

Shelf panel assembly 150 includes a shelf panel 152 that is in parallel spaced apart relation to bottom panel 114 (FIG. 11) and is supported in this position by first and second shelf support pieces 164 and 166. Here, however, support piece 164 extends longitudinally the full length of interior 130 and downwardly projects toward bottom wall 114 instead of upwardly, as was the case with first shelf support piece 164 in the first exemplary embodiment. Second shelf support piece 166 is glued to side panel 120. It is not necessary that first shelf support piece 164 be glued to side panel 118, although gluing shelf support piece 164 to side panel 118 is desirable for structural strength.

Here, also, it may be noted that shelf panel 152 not only extends the entire transverse width of interior 130 but extends the entire longitudinal length thereof instead of being slightly inset as was the case with shelf panel 52 in the preferred embodiment. However, a spacer panel 170 is still provided and is pivotally attached along front shelf edge 162 of shelf panel 152 so that it may pivot between an open and closed position. Spacer panel 170 is provided, again, with a lip 172 and a pair of tab pieces 176 and 178 to help hold it frictionally in the closed position. Aperture 180 is provided to prevent manual opening of spacer panel 170 when it is in the closed position.

A production blank 190 for carton 110 is shown in FIG. 11. Here, the construction is identical to production blank 90 except that shelf panel 152 is longitudinally lengthened and the cut-outs 199 forming tab pieces 176 and 178 are altered as shown so that fold line 198 is aligned with fold lines 194 that define flaps 136–139. Here again, the folding, gluing and other assembly and use of production blank 190 is similar to that as described with respect to the production blank 90, so that it is not again repeated.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

We claim:

1. A carton adapted for packing a plurality of items for shipment, comprising:

(a) a sidewall constructed of corrugated material and extending around an interior that is adapted to receive selected items, said sidewall having an inner sidewall surface facing the interior and having first and second open ends opposite one another, (b) a first closure constructed of corrugated material and operative to close the first open end;

(c) a second closure constructed of corrugated material and operative to close the second open end; and (d) a shelf panel constructed of corrugated material, said shelf panel disposed in the interior and supported relative to said sidewall with said shelf panel in spaced relation to a portion of said sidewall thereby to separate the interior into first and second compartments respectively adapted to receive different ones of the selected items, said first compartment having a first interior region and said second compartment having a second interior region, said shelf panel including a spacer panel disposed thereon and operative selectively to enclose the first interior region and to open to provide access to the first interior region, said spacer panel having selectable closed positions that alter the volume of said first compartment.

2. A carton according to claim 1 wherein said shelf panel is affixed to said sidewall at spaced locations.

3. A carton according to claim 1 wherein said shelf panel is parallel to said portion of said sidewall.

4. A carton according to claim 1 wherein said sidewall has a longitudinal length measured between the open ends, said shelf panel extending longitudinally at least a majority of the longitudinal length of said sidewall.

5. A carton according to claim 1 wherein said shelf panel has a first shelf edge facing the first open end and wherein said spacer panel is hingedly secured along said first shelf edge.

6. A carton according to claim 1 wherein said spacer panel includes a lip operative to retain said spacer panel in a selected one of the closed positions.

7. A carton according to claim 1 wherein the first closure is formed by a plurality of first closure flaps and wherein said second closure is formed by a plurality of second closure flaps with said sidewall, said first closure flaps, said second closure flaps and said shelf panel being constructed of an integral one-piece construction of corrugated material.

8. A carton adapted for packing a lap top computer and accessories therefor for shipment, comprising:

(a) a sidewall surrounding a longitudinally extending interior having opposite first and second open ends, said sidewall including a top panel, a bottom panel and first and second side panels, each of said top, bottom and side panels having an inner surface facing the interior;

(b) first and second end closures respectively operative to close the first and second open ends thereby to enclose the interior;

(c) a shelf panel disposed in the interior and supported in spaced relation to said top and bottom panels thereby to separate the interior into a first compartment having a first interior region sized and adapted to receive a lap top computer for shipment and a second compartment having a second interior region sized and adapted to receive accessories for a lap top computer for shipment, said shelf panel having a first shelf edge located proximately to the first open end and extending transversely across the interior; and (d) a spacer panel pivotally secured to said shelf panel along the first shelf edge and having a spacer panel edge opposite the first shelf edge, said spacer panel selectively movable from an open position permitting access to the first interior region to a closed position enclosing the first interior region, said spacer panel including a lip piece along the spacer panel edge, said lip piece operative to permit selective positioning of said spacer panel in different closed positions that establish different volumes for the first interior region.

9. A carton according to claim 8 wherein said shelf panel is substantially parallel to said top and bottom walls.

10. A carton according to claim 8 wherein said shelf panel includes a first shelf support piece affixed to an inner surface of one of said first and second side panels.

11. A carton according to claim 10 wherein said shelf panel includes a second shelf support piece affixed to an inner surface of another of said first and second side panels.

12. A carton according to claim 8 wherein said lip piece frictionally engages the inner surface of said bottom panel when in the different closed positions.

13. A carton according to claim 8 wherein said spacer panel has an aperture formed therein, the aperture being sized and adapted to permit manual engagement of said spacer panel.

14. A carton according to claim 8 wherein said spacer panel has a pair of opposite spacer panel side edges extending from the first shelf panel edge and the free edge, and including a tab piece disposed on one of said spacer panel edges.

15. A carton according to claim 14 including a tab piece on each of said spacer panel edges, said tab pieces frictionally engaging the inner surface of said first and second side panels, respectively, when said spacer panel is in the closed position with one of said tab pieces disposed in the first interior region and with another of said tab pieces disposed out of the first interior region.

16. A carton according to claim 8 wherein said first shelf edge is inset with respect to the first open end.

17. A foldable carton adapted for packing a plurality of items for shipment, comprising:

(a) a sidewall including a top panel and bottom panel each pivotally connected to a pair of opposite side panels such that said sidewall is foldable between a collapsed condition to an open condition wherein said sidewall extends around an interior region that has a rectangular cross-section and opposite first and second open ends;

(b) first and second end closure flaps respectively operative to close the first and second open ends thereby to enclose the interior region; and (c) a shelf panel operative to move between a stored state when said sidewall is in the collapsed condition to an erected state when said sidewall is in the open condition, said shelf panel affixed to each of said side panels in a manner such that movement of said sidewall from the collapsed condition to the open condition automatically moves said shelf panel to the erected state wherein said shelf panel is in spaced relation to said bottom panel thereby to separate the interior region into first and second compartments.

18. A foldable carton according to claim 17 wherein said shelf panel has a first shelf edge facing the first open end, and including a spacer panel pivotally secured to said shelf panel along the first shelf edge and having a spacer panel edge opposite the first shelf edge, said spacer panel selectively movable from an open position permitting access to the first interior region to a closed position enclosing the first interior region.

19. A one-piece construction blank formed of corrugated material and adapted to be folded and fastened into a carton for receipt and shipment of selected items, comprising:

(a) a main body portion including a pair of side panels, a top panel and a bottom panel secured to one another along longitudinally extending score lines, said main body portion formable into a tubular construction;

(b) a shelf panel assembly secured to said main body portion along a longitudinally extending shelf panel assembly scoreline, said shelf panel assembly including a first support panel connected to said main body, a shelf panel connected to said first support panel and a second support panel connected to said shelf panel opposite the first support panel; and (c) a spacer panel assembly secured to said shelf panel, said spacer panel assembly including a spacer panel along a transversely extending side edge of said shelf panel and at least one tab piece connected to a longitudinally extending scoreline of said spacer panel.

20. A carton adapted for packing a lap top computer and accessories therefor for shipment, comprising:

(a) a sidewall surrounding a longitudinally extending interior having opposite first and second open ends, said sidewall including a top panel, a bottom panel and first and second side panels, each of said top, bottom and side panels having an inner surface facing the interior;

(b) first and second end closures respectively operative to close the first and second open ends thereby to enclose the interior;

(c) a shelf panel disposed in the interior and supported in spaced relation to said top and bottom panels thereby to separate the interior into a first compartment having a first interior region sized and adapted to receive a lap top computer for shipment and a second compartment having a second interior region sized and adapted to receive accessories for a lap top computer for shipment, said shelf panel having a first shelf edge located proximately to the first open end and extending transversely across the interior, said shelf panel including a first shelf support piece affixed to an inner surface of one of said first and second side panels and a second shelf support piece affixed to an inner surface of another of said first and second side panels; and (d) a spacer panel pivotally secured to said shelf panel along the first shelf edge and having a spacer panel edge opposite the first shelf edge, said spacer panel selectively movable from an open position permitting access to the first interior region to a closed position enclosing the first interior region.

* * * * *